United States Patent [19]

Bulso, Jr. et al.

[11] Patent Number: 4,574,608

[45] Date of Patent: Mar. 11, 1986

[54] SINGLE STATION, IN-DIE CURLING OF CAN END CLOSURES

[75] Inventors: Joseph D. Bulso, Jr., Canton; James A. McClung, North Canton, both of Ohio

[73] Assignee: Redicon Corporation, Canton, Ohio

[21] Appl. No.: 698,149

[22] Filed: Feb. 4, 1985

[51] Int. Cl.[4] ..... B21D 22/00

[52] U.S. Cl. ..... 72/348; 72/347; 413/9; 413/62

[58] Field of Search ..... 72/347, 348, 349; 413/62, 9

[56] References Cited

U.S. PATENT DOCUMENTS

| | | | |
|---|---|---|---|
| 3,902,347 | 9/1975 | Ridgway et al. | 72/336 |
| 4,031,836 | 6/1977 | Grise et al. | 113/1 F |
| 4,052,949 | 10/1977 | Woodley | 113/121 C |
| 4,093,102 | 6/1978 | Kraska | 220/67 |
| 4,106,422 | 8/1978 | Buhrke | 113/121 C |
| 4,116,361 | 9/1978 | Stargell | 220/273 |
| 4,213,324 | 7/1980 | Kelley et al. | 72/405 |
| 4,244,315 | 1/1981 | Klein | 113/121 C |
| 4,372,720 | 2/1983 | Herdzina et al. | 413/56 |
| 4,420,283 | 12/1983 | Post | 413/8 |

*Primary Examiner*—Leon Gilden
*Attorney, Agent, or Firm*—Reese Taylor

[57] ABSTRACT

Method and apparatus for forming end closures for containers complete with a peripheral curl for attachment to the top of a container without press modification includes a unique split die core ring. The method includes performing the operations of blanking the end panel against the cut edge, forming the chuckwall against the die core ring with a punch and punch shell and finally setting the chuckwall by wiping over the radius of the die core ring against a fluidly supported piston and simultaneously applying a curl to the peripheral edge of the panel prior to completion and removal from the press station. The method is performed by utilization of a split die core ring having inner and outer concentric segments, the outer segment of which is withdrawn as the punch shell advances to initiate a curl between the inner face of the punch shell and the outer face of the fixed inner segment of the die core ring. The apparatus for carrying out the method includes a conventional double acting press with a punch core on the inner slide, a punch shell on the outer slide and a die core on the fixed base. A split die core ring is employed on the fixed base and comprises a fixed inner ring and movable outer ring. The inner and outer rings are designed so as to effectively operate as a single ring during the initial forming operation. During the curl forming operation, however, the punch shell moves the outer portion of the split die core ring out of the way and forms the curl in the peripheral edge surface of the closure in the space vacated thereby.

11 Claims, 7 Drawing Figures

SINGLE STATION, IN-DIE CURLING OF CAN END CLOSURES

BACKGROUND OF THE INVENTION

This invention relates in general to a method and apparatus for forming end closures for two- or three-piece containers for food or beverages. The invention relates in particular to the formation of such end closures having a hook or a curl on the peripheral edge thereof.

DESCRIPTION OF THE PRIOR ART

It is well known that food and beverages and indeed other products can be packaged in metal containers or cans. These containers generally are of either two-piece construction wherein the body and the bottom of the container are ironed, drawn, etc., from a single piece of metal and the top is a separate piece, or of three-piece construction wherein the body is formed from a single piece of metal and the top and bottom closure members are separate pieces.

In either instance, adding the end closure usually involves a seaming operation and in order to accomplish this operation the container body is formed with what is variously termed a hook, lip or curl on its top edge surface and the closure is formed with a similar hook or curl about its perhphery and suitable seaming apparatus is employed to engage the respective curls to provide a sealed container.

The present invention is directed to a method and apparatus for efficiently forming such an end closure.

As noted, the purpose of the peripheral flange, which, as noted, is sometimes called a hook or curl, on a can end closure for two- or three-piece cans, is to provide an element which makes it possible to interconnect the can end and the top of the can by deforming the end flange of the can together with the peripheral flange hook or curl of the can end to form a double seam to prevent leakage, etc. Early formation of this curl also prevents one or more closures from sticking together or forming "doubles" which can cause difficulties during subsequent operations.

Examples of the types of curls or hooks referred to here in general can be seen in Post U.S. Pat. No. 4,420,283; Klein U.S. Pat. No. 4,244,315; Kraska U.S. Pat. No. 4,093,102; and Woodley U.S. Pat. No. 4,052,949.

Generally speaking, the prior art teaches that the curl or hook on the can end closure can be formed by one of two broadly defined methods.

One of these methods involves the utilization of a separate rotary curler. In this instance, the can end is essentially drawn, redrawn, and formed to set the chuckwall and, in the event of a easy open container, to form the rivet and apply the tear away or push-in portion of the lid or end. It is then removed from the press and the edge is curled by curling rolls, such as can be seen in Stargell U.S. Pat. No. 4,116,361. One of the difficulties with this approach is that the end piece must generally be initially formed oversized.

The other generally used method of forming the peripheral curl on the can end involves forming the curl at one of a number of successive stations within the press. In this method, the material passes through a number of operations, starting with the blank or flat plate stock, and proceeding through various drawing and redrawing operations to form the chuckwall and the other contoured surfaces. One of the successive stations in this progressive operation is one in which the curl or hook is formed. Examples can be seen in Kelley U.S. Pat. No. 4,213,324 and Buhrke U.S. Pat. No. 4,106,422.

In both of the methods just described, there is obviously a primary disadvantage in that the can end has to be moved from one station to another within the press or even entirely out of the press, depending on the method that is employed, in order to complete the curl.

Recognizing this disadvantage, some attempts have been made to form the curl or hook on the peripheral edge of the can end at the same station at which other forming operations take place and without removing it from the press.

Grise U.S. Pat. No. 4,031,836 shows such a single-station machine wherein particular curl or hook forming tooling is added to the normal forming tooling. Reference is had to FIG. 9 of the drawings of the Grise reference wherein the undersurface 72 of the upper die 70 has an annular recess 74 and the coining tool 80 has an outer forming ring 82 which forms the curl.

Herdzina U.S. Pat. No. 4,372,720 also covers a two-step, single-station method wherein the curl is preformed by a first operation and then finally reformed in an independent, second operation.

This art, however, requires relatively complex tooling which adds to the manufacturing expense and creates undesirable maintenance problems.

SUMMARY OF THE INVENTION

It has been discovered that the difficulties encountered in the prior art just discussed can be obviated by producing single station tooling which can be employed without any press modification and which enables the end closure or end piece to be formed from a sheet of metal through the drawing, redrawing, and scoring operations of the type generally performed on closures of this type.

It has been found that by modifying the tooling slightly it is possible to simultaneously, at the same station, form the hook or curl on the peripheral edge, thereby avoiding transferring the closure from one station to another and also avoiding the requirement for providing separate tooling to form the curl.

To that end, it has been discovered that, by providing a split die core ring, the normal forming operations can be performed to transform the metal from a flat blank to the contoured closure while subsequently, and at the same station, provide the curl on the peripheral edge.

It has been found that this can be accomplished with such split ring tooling wherein the split ring operates as a single unitary ring during the normal forming operation and then is separated into two rings, one of which is stationary and one of which moves relatively of the other during the formation of the curl.

The method involved includes the utilization of such apparatus by applying the curl to the peripheral edge of the panel prior to the removal of the closure from the press by utilizing a punch shell in cooperation with the fixed die core ring to form the curl in the area vacated by the movable die core ring.

Accordingly, production of an approved method and apparatus for single station, in die curling of can end closures of the type just described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
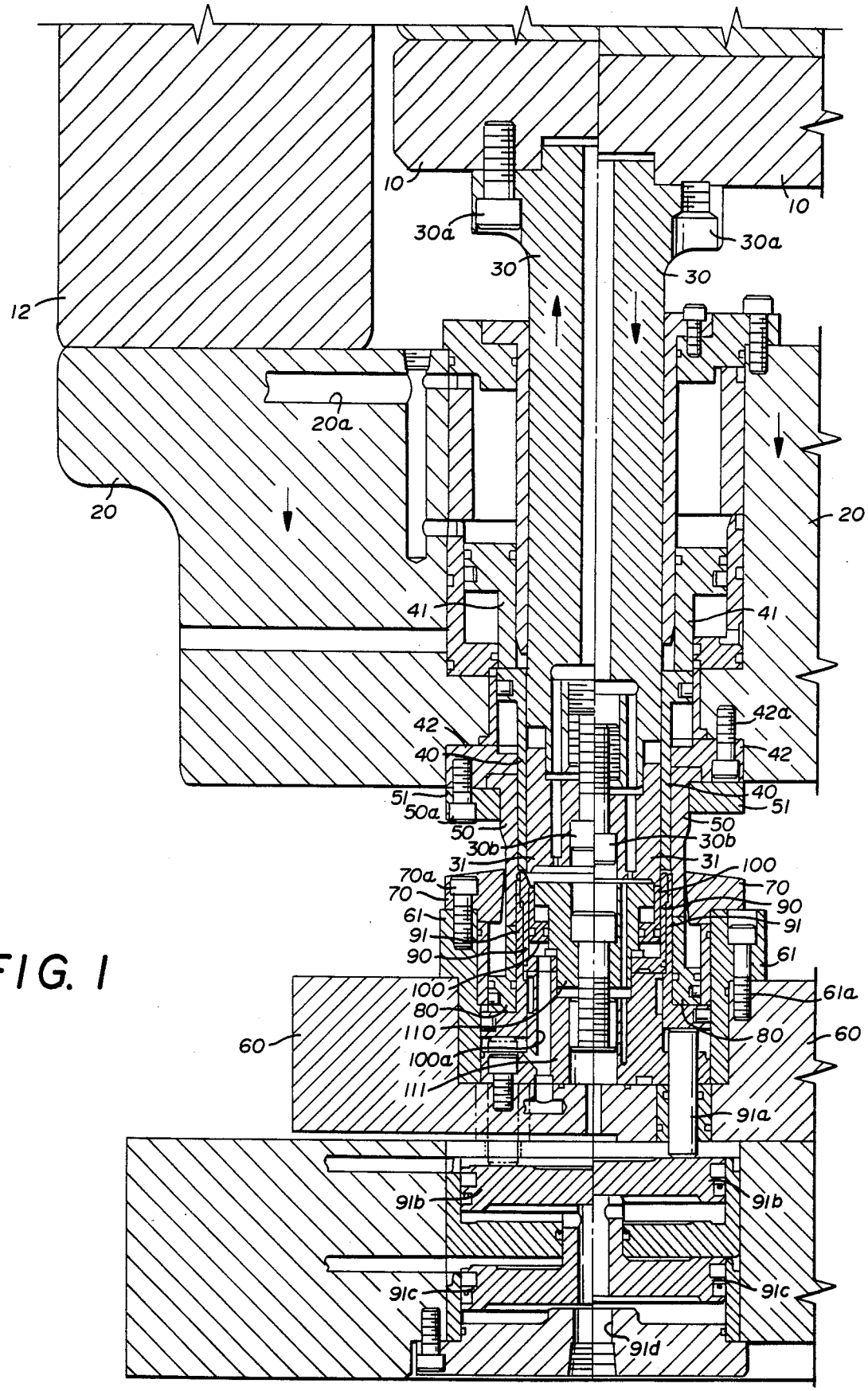
FIG. 1 is a split elevational view, in section, showing on the right hand side the tooling and press components in the pre-curl position, as illustrated in detail in FIG. 4. The left hand side of FIG. 1 illustrates the press and tooling components in the final curl position and rotated 90°, as illustrated in detail in FIG. 5.

As previously noted, the tooling and apparatus of the present invention are intended to be utilized in a double acting press and, to that end, FIG. 1 of the drawings illustrates an inner ram 10 and an outer ram 12 independently movable toward and away from a die holder 60 supported on a suitable bolster and fixed base. The press has not been described in great detail since such presses, as exemplified by the press disclosed in Ridgeway U.S. Pat. No. 3,902,347, are relatively well known in this art. Suffice it to say, however, that presses of the double acting type make it possible to accurately control operation of the tooling carried thereby during various stages of the press cycle.

Still referring then to FIG. 1 of the drawings for a detailed description of the tooling carried by the inner and outer ram, it will first be noted that the right hand side of FIG. 1 illustrates the tooling in what may be called the pre-curl position while the left hand side illustrates the tooling in what may be called the final curl stage of the operation.

Figure 4:
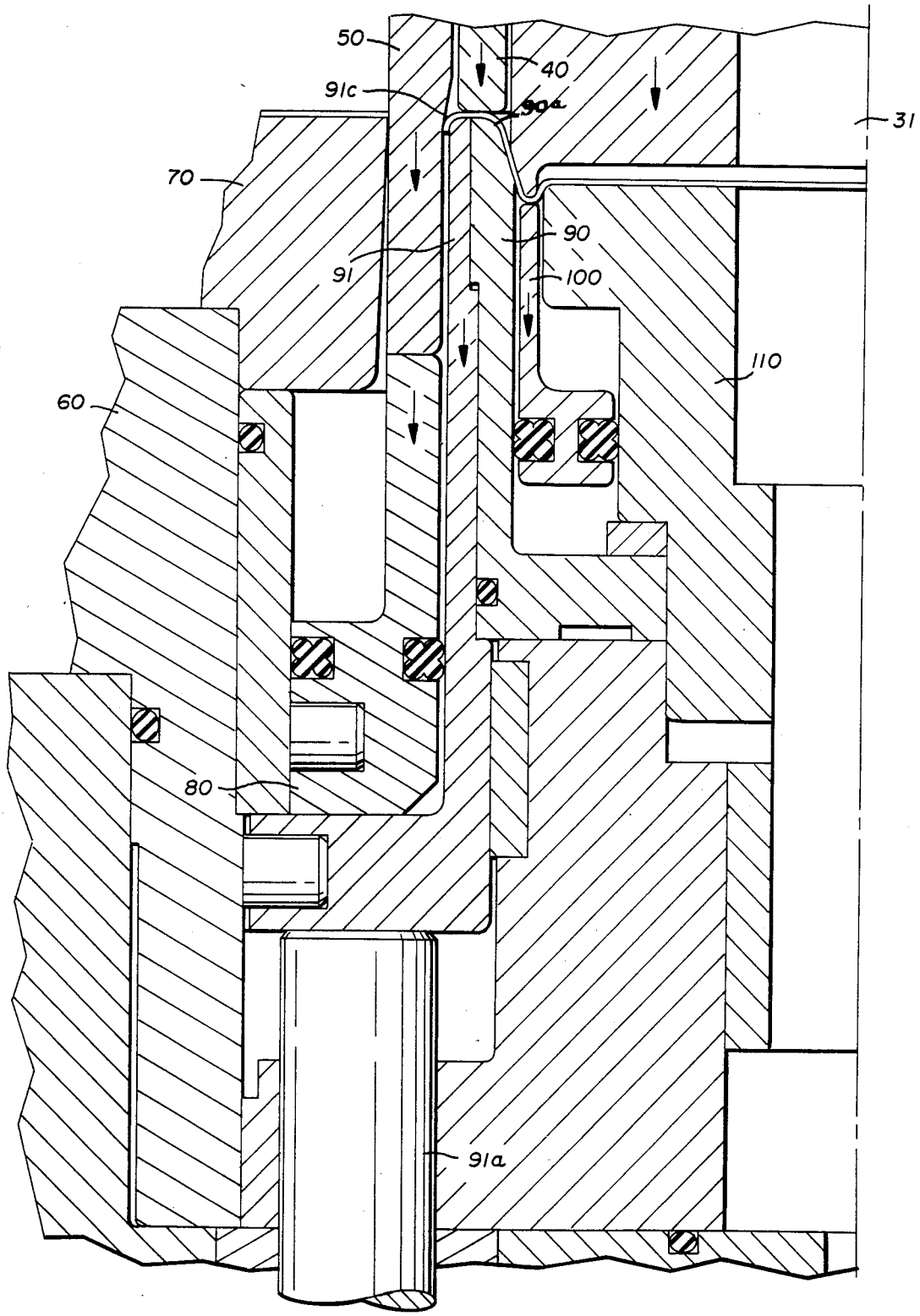
FIG. 4 is an enlarged, partial sectional view showing the tooling at the pre-curl stage of operation.
Figure 5:
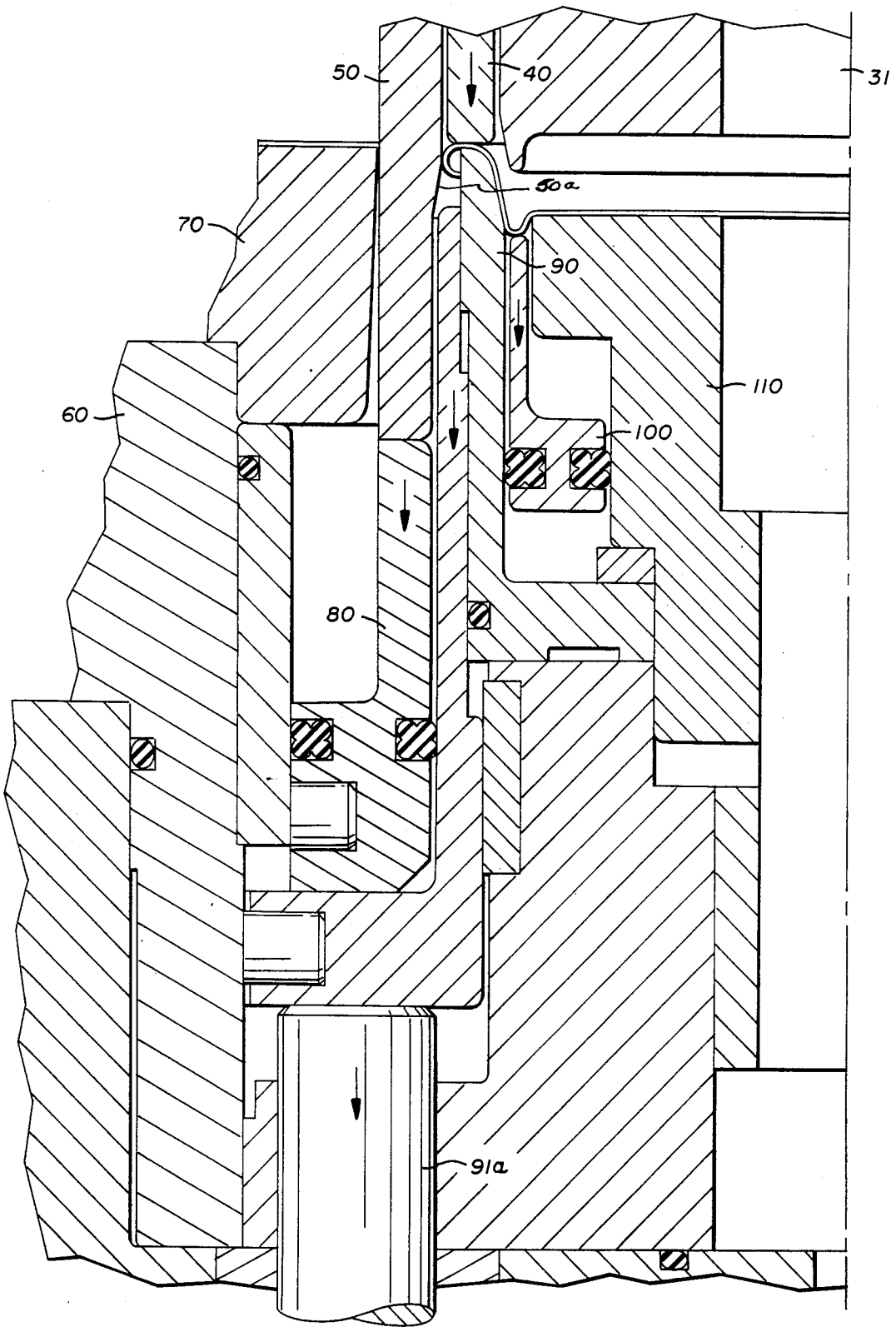
FIG. 5, is an enlarged, partial sectional view showing the tooling at the final curl stage of operation.

In other words, the right hand side of FIG. 1 illustrates the tooling essentially in the position shown in greater detail in the enlarged view of FIG. 4 of the drawings while the left hand side illustrates the tooling in greater detail corresponding to the position shown in the enlarged view of FIG. 5 of the drawings.

Continuing then to refer in general to FIG. 1, it will be noted that the inner ram 10 carries a punch center post 30 secured thereto, for movement therewith, by a plurality of screws 30*a*. Attached to the projecting or distal end of the punch center post 30, by screw 30*b*, is the punch core 31 which is intended to impart the desired configuration to the can end, as will be described.

The outer punch holder 20, which is carried by the outer ram 12, carries a pressure sleeve system which includes a pressure sleeve 40 and a pressure sleeve piston 41. The piston 41 is actuated by pneumatic or hydraulic pressure supplied through the bore 20*a* of the punch holder 20 from a suitable source for such fluid (not shown). This double piston arrangement makes it possible to increase the operational force without increasing line pressure. Again, specific detail has been eliminated for clarity of illustration although it should be understood that sufficient pressure can be exerted through the bore 20*a* to activate the piston 41, forcing it against the pressure sleeve 40 and thereby forcing the pressure sleeve toward the die holder 60 and the bolster and fixed base for holding purposes, as will be described.

The outer punch holder 20 also carries a pressure sleeve retainer 42 which is secured to the punch holder by a plurality of screws, such as the screw 42*a*.

Concentric with and disposed externally of the pressure sleeve 40 and also carried by the outer punch holder is a punch shell 50 which is held onto the punch holder by the clamp ring 51 and secured thereto by suitable screws, such as 50*a*.

The die holder 60, still referring to FIG. 1, carries on its top surface a die support ring 61 which is held onto the die holder 60 by a plurality of screws, such as 61. Mounted on top of the support ring 61 is the blank cut edge 70, similarly held in place by attachment screws such as 70*a*.

Received internally of die support ring 61 and cut edge 70 is a second pressure sleeve 80 which is normally urged to the up position or toward the top of the press by suitable fluid pressure, such as hydraulic or pneumatic by means which will be described below.

It should be noted here that FIG. 1, which is a split sectional view as already noted, illustrates the tooling in essentially the positions shown in greater detail in the enlarged views of FIGS. 4 and 5. In both of these instances the pressure sleeve 80 will have been forced downwardly overcoming its supporting fluid pressure, as is illustrated in both the left and right hand sides of FIG. 1.

Received still further inwardly and concentrically with the pressure sleeve 80 is a split die core ring referred to by the numbers 90 and 91.

Outer die core ring 91 is disposed adjacent the pressure sleeve 80 while inner die core ring 90 is received just internally thereof. Through some of the stages of operation, these inner and outer die core rings will effectively operate as a single, undivided ring. However, during the forming of the curl or hook on the periphery of the container end closure they will separate and operate independently, as will be described in greater detail below. Suffice it to say here that the inner die core ring 90 is fixed and does not move relative to the die line whereas the outer die core ring 91 is, in fact, movable and is normally supported with its top surface at the die line in the position of, for example, FIGS. 2 and 3 of the drawings by pneumatic or hydraulic pressure as illustrated in FIG. 1 and described below.

Figure 2:
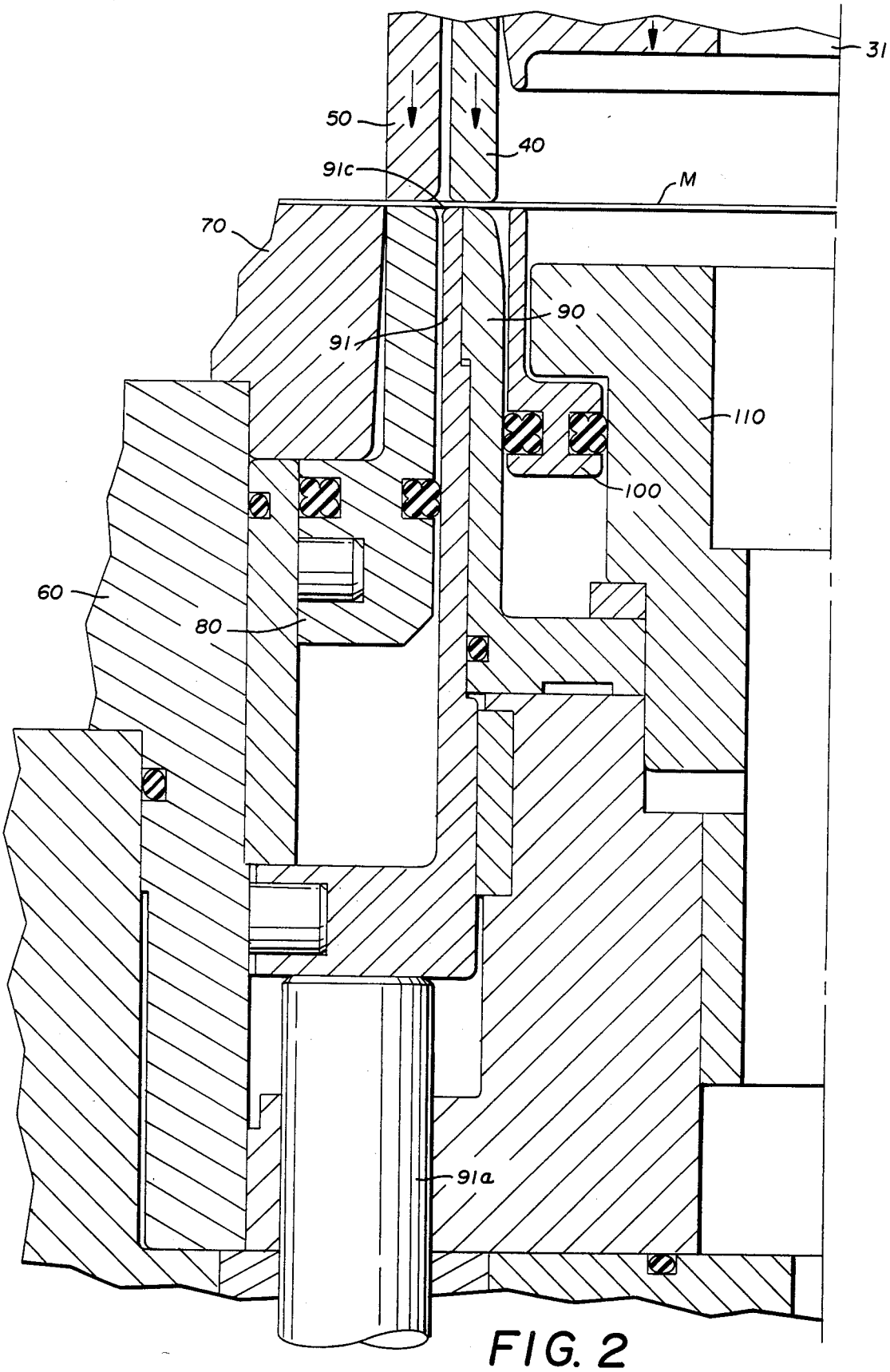
FIG. 2 is an enlarged, partial sectional view showing the tooling at the blanking stage of operation.
Figure 3:
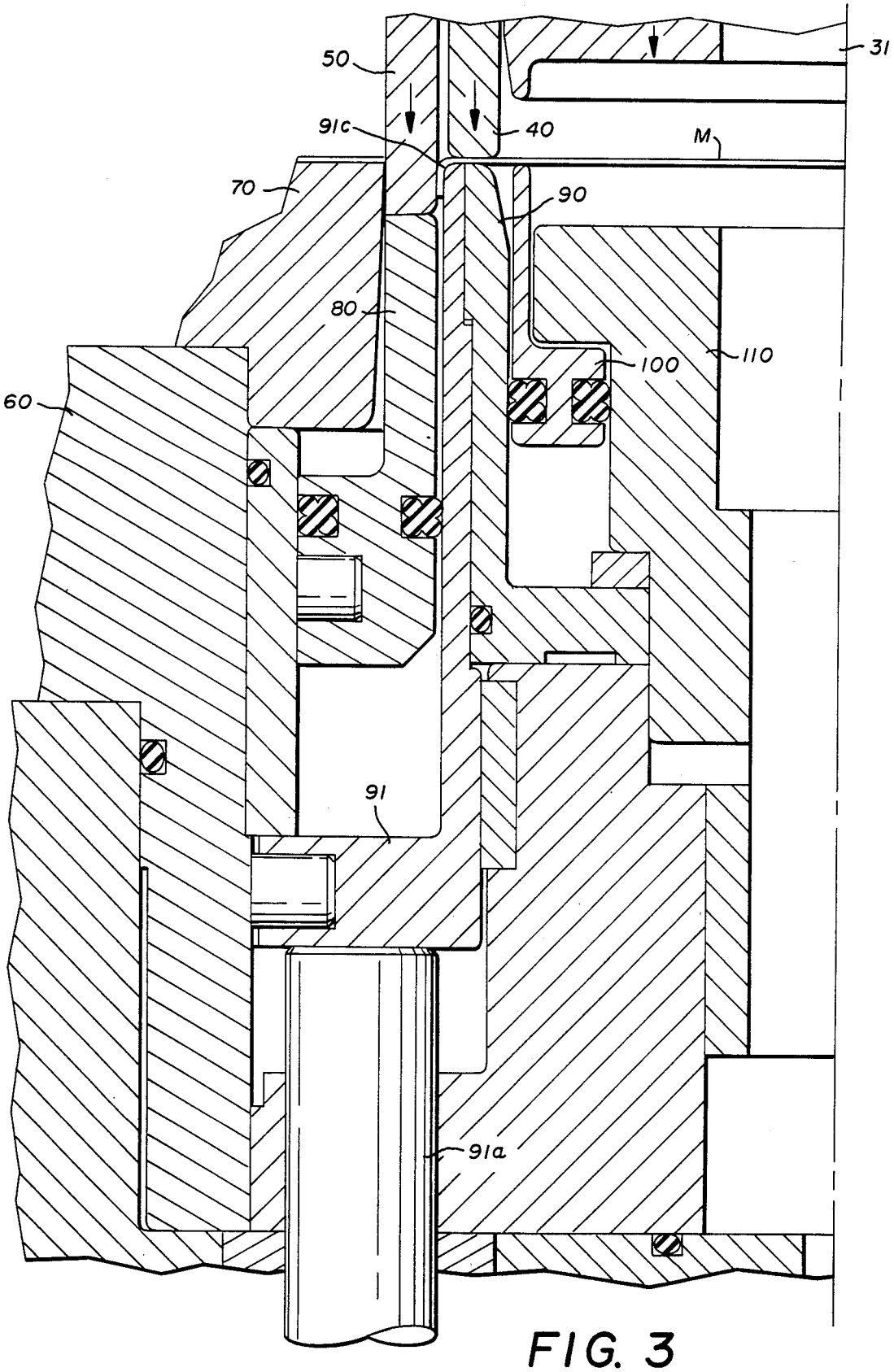
FIG. 3 is an enlarged, partial sectional view showing the tooling at the reverse draw stage of operation.
Figure 6:
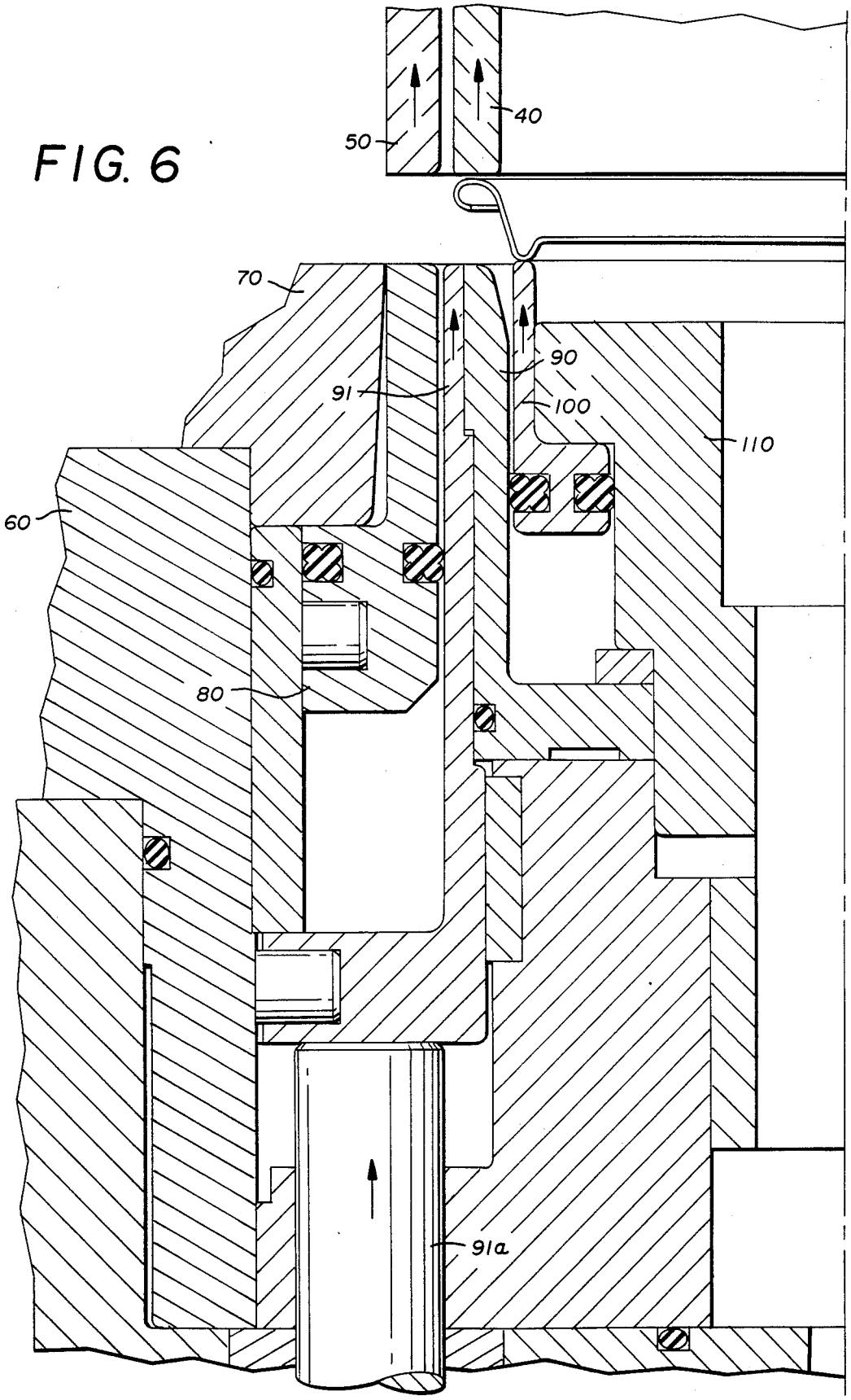
FIG. 6 is an enlarged, partial sectional view showing the tooling at the lift out stage of operation.
Figure 7:
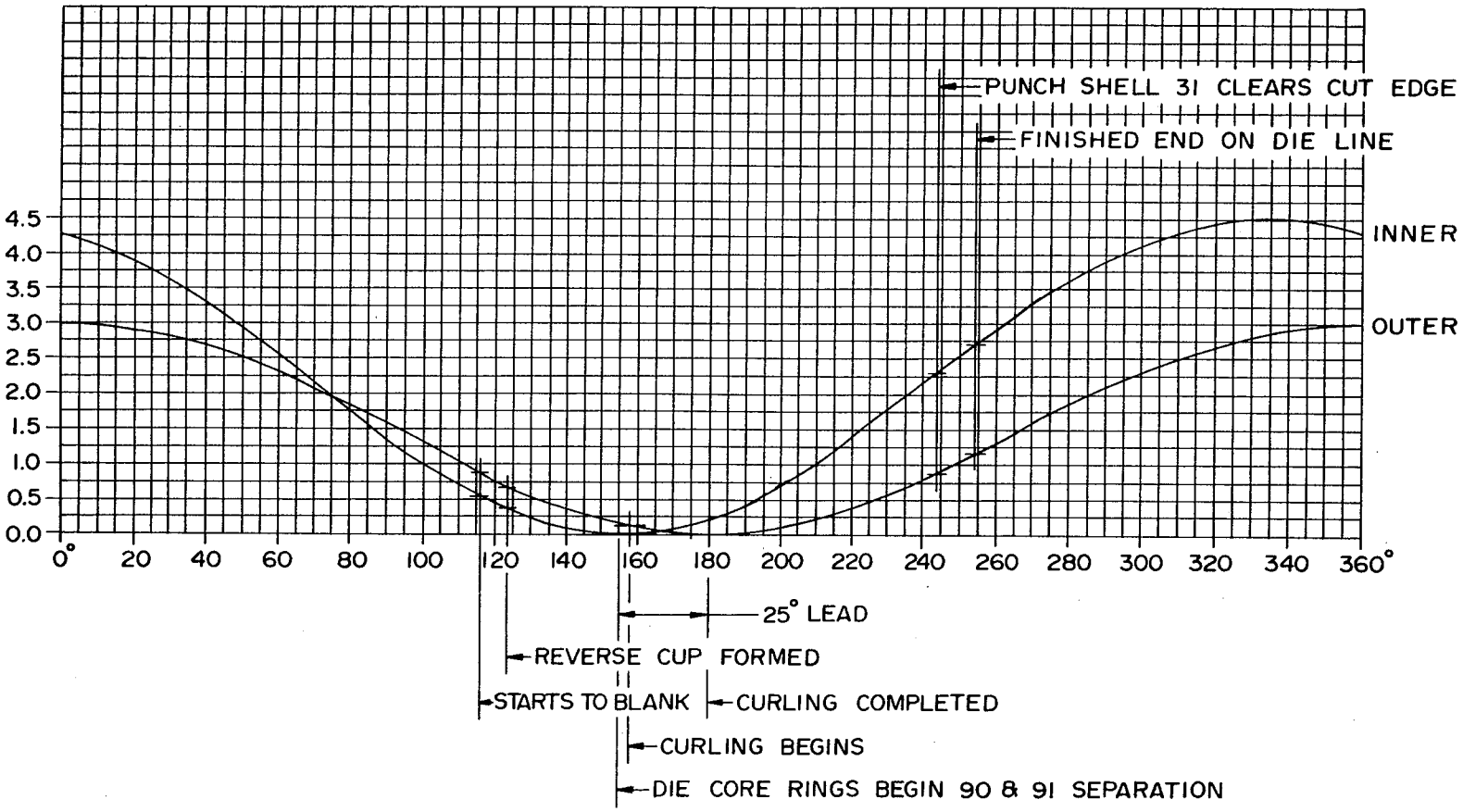
FIG. 7 is timing diagram

Disposed still further radially inwardly and concentrically mounted is a knockout piston 100 which is fluid actuated through bore 100*a* and normally urged toward the die line as, for example, illustrated in FIGS. 2, 3, and 6 of the drawings.

Concentrically received within the knockout piston 100 is the die core 110 which is fixed to the die core riser 111 which is, in turn, mounted on the die holder 60 and which, it should be noted, does not move during operation of the tooling or the press.

Still referring to FIG. 1 of the drawings and particularly to the outer die core ring 91, it will be noted, with particular reference to the right hand side of FIG. 1, that that die core ring rests on a rod or rods 91*a* which, in turn, rest on a first piston 91*b* which again, in turn, rest on a second piston 91*c*. Fluid pressure is supplied through the port 91*d* in the bolster beneath die holder 60 so as to, at suitable times, apply fluid pressure on the pistons 91*c* and 91*b*, to rod 91*a*, and the outer die core ring 91. This pressure will normally urge that die core ring 91 toward the die line.

Also, it will be noted that die core ring 91 has a radially outwardly projecting flange adjacent to its bottom edge and that the bottom of pressure sleeve 80 can be moved into engagement therewith. Thus, the pressure sleeve 80 is normally fluidly supported and normally urged to the upper position until displaced by punch shell 50, as will be described. Similarly, die core ring 91 is normally fluidly supported and urged to the up position until displaced by pressure sleeve 80, as will also be described.

Turning then to FIGS. 2 through 7 for a description of the operation of the tooling, it will first be assumed that, as illustrated in FIG. 2, the blanking operation is about to begin.

At this point the pressure sleeve 40 will have been actuated by the fluid pressure thereon and brought into holding contact with the metal M, trapping the metal between its bottom end and the top edges of the inner and outer die core rings 90 and 91 which operate as a single die core ring at this stage. Also at this time, the punch shell 50 will be descending, as will be the punch core 31.

During the transition from the position of FIG. 2 to FIG. 3, the punch shell 50 will sever the metal against the cut edge 70. The fluid pressure on outer punch core ring 91 will be sufficient to maintain it in the position of FIG. 2 and downward movement of the punch shell 50 will wipe the peripheral edge of the blank down about the radius 91*c* of the top of the outer punch core ring 91, as clearly shown in FIG. 3 of the drawings, at which point, effectively, a reverse drawn cup has been formed. It should be noted here that the just described downward movement of the punch shell 50 overcomes the fluid pressure beneath the second pressure sleeve 80, moving it downwardly as well.

Turning then to FIG. 4 of the drawings, it will be noted that several operations take place simultaneously. First, punch core 31 continues downwardly and forces the metal against the top surface of die core 110. This movement forms the chuckwall by pulling the metal over radius 90*a* of inner die core ring 90 with the fluid pressure which supports knockout piston 100 also being overcome, and the piston being moved out of the way.

Additionally, with pressure still being held by the pressure sleeve 40 against the top of die core rings 90 and 91, continued downward movement of punch shell 50 will begin to curl the peripheral edge, as can be seen in FIG. 4. Also, sleeve 80 will be forced down by punch shell 50 a short distance and, as illustrated in FIG. 4, engages the bottom flange of die core ring 91.

At the stage of operation illustrated in FIG. 4, the inner ram has reached bottom dead center and downward movement of the punch core 31 has stopped. However, the outer ram is still moving downwardly so that the tooling carried by the outer ram and the tooling carried by the die holder 60 move from the positions illustrated in FIG. 4 to that of FIG. 5.

Specifically, as punch shell 50 continues its downward movement, it will continue to force sleeve 80 downward. Since sleeve 80 is in engagement with die core ring 91 at this time, ring 91 also will be moved downwardly overcoming the fluid force on pistons 91*b* and 91*c*. This leaves a space between the outer periphery of die core ring 90 and punch shell 50, as clearly illustrated in FIG. 5.

It will also be noted that the punch shell 50 has a given inner diameter throughout most of its length but is tapered toward its bottom end as at 50*a* so as to present an enlarged inner diameter area. Keeping in mind that a space has been formed by the downward movement of die core ring 91 and that the can end is held between pressure sleeve 40 and inner die core ring 90, the tapered surface 50*a* of punch shell 50 completes the curl by camming the lip of the can end in that space. At this point also, the inner ram is moving up and the outer ram has reached bottom dead center.

FIG. 6 of the drawings illustrates the position of the components at the lift out stage wherein pressure sleeve 40 has been pulled up and away from the die holder 60 while the punch core 31 has also moved up and away. With the outer ram moving up, of course, the punch shell 50 also moves up and movement of the punch core 31 away from the bottom platen and movement of the pressure sleeve 40 out of holding position permits the knockout piston 100 to be moved back upwardly to move the finished container end to the die line for removal from this station. It will also be noted in FIG. 6 that the pressure sleeve 80, no longer being held down by punch shell 50, rises and allows the outer die core ring 91 to rise to the position shown in FIG. 6 which is the finishing position as well as the starting position for the next operation.

It will be seen then, that the end closure can be completely formed, including formation of the curl, at one station. This is thus accomplished with a relatively simple tooling which is relatively maintenance free and does not require any press modification.

While a full and complete description of the invention has been set forth in accordance with the dictates of the Patent Statutes, it should be understood that modifications can be resorted to without departing from the spirit hereof or the scope of the appended claims.

What is claimed is:

1. In a method of forming the end panel of a metal container which includes blanking the panel against a cut edge, forming the chuckwall against a die core ring with a punch and punch shell, finally setting the chuckwall by wiping over the radius of the die core ring against a fluidly supported piston and removing the panel from the press, the improvement comprising:

applying a curl to the peripheral edge of the panel prior to removal from the press by providing a split die core ring having inner and outer concentric segments and withdrawing the outer segment while simultaneously advancing the punch shell to initiate a curl between the inner face of the punch shell and the outer face of the inner segment of the die core ring.

2. The method of claim 1 wherein said outer segment of said die core ring is normally fluidly supported; said advancement of said punch shell overcoming said fluid support.

3. The method of claim 1 wherein said punch shell has a tapered inner surface; said tapered inner surface camming the periphery of the end panel during a portion of said advancement of said punch shell.

4. The method of claim 1 wherein the periphery of the end panel is supported by a pressure sleeve during said blanking operation; said punch shell being movable into engagement with said pressure sleeve during forming of the chuckwall.

5. The method of claim 4 wherein said pressure sleeve is moved into engagement with said outer segment of said split die core ring upon advancement of said punch shell and said pressure sleeve and said outer segment of said split die core ring are movable together during further advancement of said punch shell.

6. The method of claim 1 wherein said outer segment of said die core ring is advanced as said punch shell withdraws to complete the peripheral curl.

7. Apparatus for forming the end panel of a metal container in a double acting press having inner and outer slides and a fixed base, comprising:

(A) a punch core carried by the inner slide of said press;

(B) a punch shell carried by the outer slide of said press;

(C) a die core carried by the fixed base of said press;

(D) a die core ring carried by the fixed base in concentric relationship with said die core;

(E) said punch shell being movable toward said fixed base to wipe the periphery of said end panel over the radius of said die core ring;

(F) said punch shell having a tapered area on its inner face extending radially inwardly from its distal end;

(G) said die core ring comprising inner and outer segments;

(H) said outer segment being movable relatively of said inner segment as said punch shell moves toward the fixed base of the press (I) whereby a curl is inititated about the periphery of the end panel between the inner face of the punch shell and the outer face of the inner segment of the die core ring.

8. The apparatus of claim 7 wherein seaid outer segment of said die core ring is normally fluidly supported; said punch shell forcing said outer segment away from its normal position during a portion of the movement of said punch shell toward the fixed base.

9. The apparatus of claim 7 wherein a pressure sleeve is carried on the fixed base concentric with said die core ring, externally thereof and in opposed relationship with said punch shell.

10. The apparatus of claim 9 wherein said punch shell is movable into engagement with said pressure sleeve during a portion of its movement toward the fixed base; said punch shell and said pressure sleeve being movable together during a further portion of the movement of the punch shell toward the fixed base.

11. The apparatus of claim 10 wherein said pressure sleeve is movable into engagement with said outer segment of said die core ring following engagement by said punch shell; said outer segment of said die core ring, said pressure sleeve and said punch shell being movable together during said further movement of said punch shell toward the fixed base.

* * * * *